United States Patent [19]

Spiers

[11] Patent Number: 4,608,798

[45] Date of Patent: Sep. 2, 1986

[54] MODULAR BUILDING COMPONENT FOR PATIO AND DECK FLOORS, PLANTERS, BENCHES AND THE LIKE

[76] Inventor: Barry Spiers, 6-124 Connie Street, Concord, Ontario, Canada

[21] Appl. No.: 513,427

[22] Filed: Jul. 13, 1983

[30] Foreign Application Priority Data

Apr. 28, 1983 [CA] Canada ..... 426966

[51] Int. Cl.[4] ..... E04C 2/42; E04F 15/02

[52] U.S. Cl. ..... 52/581; 52/667; 52/819; 160/130; 297/452

[58] Field of Search ..... 52/343, 581, 819, 667; 160/130, 236; 297/452

[56] References Cited

U.S. PATENT DOCUMENTS

| | | | |
|---|---|---|---|
| 118,952 | 9/1871 | Lewis | 52/663 |
| 945,575 | 1/1910 | McPherson | 52/667 X |
| 1,779,497 | 10/1930 | Secor | 52/667 |
| 3,369,337 | 2/1968 | Butler | 52/667 |
| 3,621,631 | 11/1971 | Cutler | 52/581 X |
| 4,289,563 | 9/1981 | Wiechowski et al. | 52/667 X |

FOREIGN PATENT DOCUMENTS

| | | | |
|---|---|---|---|
| 259230 | 3/1926 | Canada . | |
| 613447 | 1/1961 | Canada . | |
| 633299 | 12/1961 | Canada . | |
| 637100 | 2/1962 | Canada . | |
| 744531 | 10/1966 | Canada . | |
| 762654 | 7/1967 | Canada . | |
| 867070 | 3/1971 | Canada . | |
| 1076860 | 5/1980 | Canada . | |
| 2163155 | 7/1973 | Fed. Rep. of Germany | 52/581 |
| 499806 | 2/1920 | France | 52/342 |
| 562425 | 9/1923 | France | 52/342 |
| 26464 | of 1898 | United Kingdom | 52/667 |

*Primary Examiner*—Alfred C. Perham
*Attorney, Agent, or Firm*—Kenyon & Kenyon

[57] ABSTRACT

There is provided a new and useful building component comprising a first series of elongated members arranged in parallel spaced apart relationship, at least two sets of aligned openings extending transversely through the first series of members, a second series of at least two elongated members extending substantially through respective ones of the sets of openings, and means for securing the first set of members to the second set of members in said parallel spaced apart relationship.

3 Claims, 6 Drawing Figures

MODULAR BUILDING COMPONENT FOR PATIO AND DECK FLOORS, PLANTERS, BENCHES AND THE LIKE

BACKGROUND OF THE INVENTION

This applicat1on invention relates to a building component. More particularly, this invention relates to a modular building component.

Over the past few years there has been an increasing emphasis on efficient use of raw materials in industry and particularly on the reduction of waste. As costs of production have continued to rise, it has become more important to ensure to as great an extent as possible total usage of inputs to production. It was in part this factor that led to the development of the present invention.

In the wood products industry the step of cutting wood to size for a particular purpose frequently results in leftover cuttings which are not readily suited for other uses. The cumulative effect is that there is a good deal of waste in both material and financial resources.

The present invention offers the potential to utilize some of this "waste" in a constructive manner.

Furthermore, there has arisen over the past few years great interest in the use of modular components which are capable of utilization in a variety of different ways. Any such standardization of manufacturing to allow multiple uses of a product is clearly advantageous for many reasons. Among these are the enhanced marketability of the products and the economy of manufacture of larger volumes of a single product. The present invention provides a multiple use building component which offers these advantages.

The present invention deals particularly with the utilization of relatively small pieces of lumber, some of which might otherwise have been waste cuttings, to construct a modular building unit having a wide range of uses. The modules are particularly adaptable, for example, to the manufacture for flooring for patios and decks, furniture, particularly of the type of outdoor use, and accent pieces such as planters, retaining walls and the like.

PRIOR ART

To the best of applicants knowledge it has generally been the case that the various use categories discussed above have not been susceptible of application of modular construction techniques. Rather, each item has been individually manufactured, often with matching style, but not with modular components. Even then, the common technique for manufacture of wood strip items is to affix the strips to the top of a rigid support structure, a technique having no similarity to that of the present invention.

The applicant is unaware of any specific pieces of prior art pertaining to this invention.

SUMMARY OF THE INVENTION

In its broad sense the invention utilizes a series of elongated strips, which are preferably of wood, arranged in spaced parallel relationship. The strips are secured to a series of transverse members which pass through the strips. The transverse members are preferably of circular cross section and are fitted through corresponding cylindrical openings through the strips.

Thus, the invention provides a building component comprising a first series of elongated members of arranged in parallel spaced apart relationship, at least two sets of aligned openings extending transversely through the first series of members, a second series of at least two elongated members extending substantially through respective ones of the sets of openings, and means for securing the first set of members to the second set of members in the parallel spaced apart relationship. In most cases the first series of members will be of equal length.

In a further embodiment the individual ones of the members of the second set are flexible.

BRIEF DESCRIPTION OF THE DRAWINGS

In drawings which illustrate embodiments of the invention.

Figure 1:
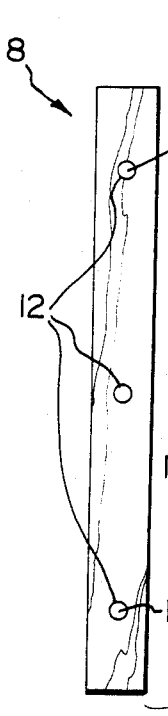
FIG. 1 is a side elevation of a module according to the invention.

While the invention will be described in conjunction with the embodiments set out in the drawings, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
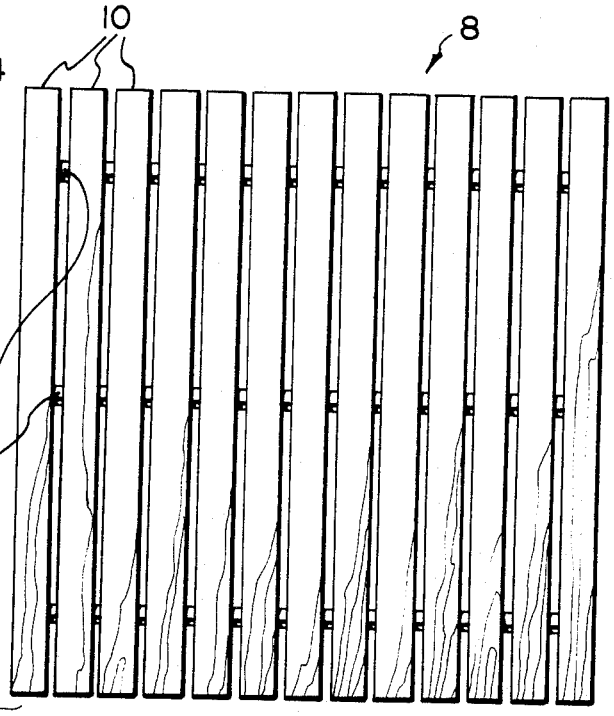
FIG. 2 is a top plan view of the module of FIG. 1.
Figure 3:
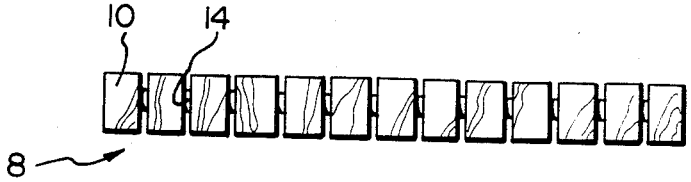
FIG. 3 is an end elevation of the module of FIG. 1.

With reference to FIGS. 1 to 3, the building module 8 of the present invention comprises a first series of elongated members 10 arranged in parallel spaced relationship. The members 10 are provided with at least two sets of aligned openings 12 extending transversely through the members. As illustrated, the preferered number of sets of openings is three.

A second series of elongated members 14 extend through the sets of aligned openings 12 and the members 10 are secured in place on members 14.

The members 10 are preferably of equal length. The length of the module 8 may vary as may the number of members 10 in the module. Similarly, the dimensions of the individual members in cross section may be varied as desired.

A typical preferred configuration would utilize members 10 of wood of nominal size 2 inch by 2 inch in a module about 2 feet on the side.

The preferred material in general for the members 10 is wood.

The preferred cross section of the openings 12 is circular, and the members 14 are preferably cylindrical. Typically, openings 12 might be of $\frac{5}{8}$ inch diameter, although wide variation is possible. Depending on the particular end uses, the members 14 may be of various materials, including, for example, wood or plastic. In the most preferred embodiment, the members 14 are of flexible plastic, such as, for example, PVC, of specified flexibility and durometer rating, and are of tubular configuration. Typically, the tubing might be of about 5/16 inch inside diameter.

Where the members 14 are of flexible plastic, the module can be flexed in the longitudinal direction of members 14 to provide an additional wide variety of uses.

The manner of securing the members 10 in place on the members 14 may be by any suitable means. This may be by staples through members 10 into members 14, by clinching of members 14, or other means of deformation of members 14, for example.

Figure 4:
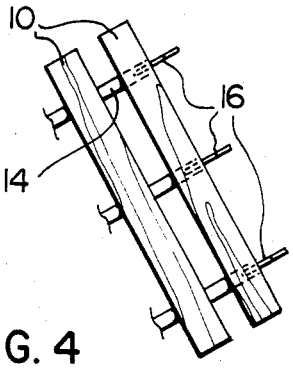
FIG. 4 illustrates one manner of interconnecting the modules of the invention.

With reference to FIG. 4, a method is illustrated of interconnecting modules 8 in a side by side configuration. The members 14 in this case are provided with a central bore extending at least part way into members 14. In the case where the members 14 are of plastic tubing, the central bore will already be present. Plugs 16 are provided extending into the outer ends of the bores of adjacent members 14 in the terminal members 10. A second module is then fitted to the free ends 18 of the series of plugs. A series of plugs 16 will provide an effective joint.

Figure 5:
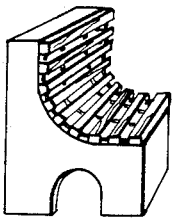
FIG. 5 is a perspective showing one application of a module according to the invention.
Figure 6:
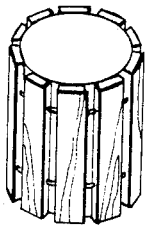
FIG. 6 is a perspective showing a further application of the invention.

As indicated above, the modules are susceptible of a wide variety of uses. These include a basic use as a patio or deck floor component. FIGS. 5 and 6 illustrate further uses as a chair seat and back, and a planter, respectively. In both of these cases the advantages of the flexibility of members 14 is illustrated.

Other uses include that as a floor in showers and saunas, in walkways, in table tops and legs and the like. In short, the modules are very versatile and lend themselves to great variety of use.

Thus it is apparent that there has been provided in accordance with the invention a new and useful building component that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A modular building component comprising a series of elongated members arranged in parallel closely spaced apart relationship, each said member having at least two openings extending transversely therethrough; and at least one pair of elongated flexible hollow tubes extending through said openings transversely of said members and secured in and to each respective member, each said tube having an exposed bore at each end to receive a plug for joining with an adjacent modular building component.

2. A modular building component as set forth in claim 1 wherein each plastic tube is deformably received in a respective opening of an adjacent elongated member.

3. A modular building component as set forth in claim 1 which further comprises means securing each elongated member to a respective plastic tube.

* * * * *